US005257592A

United States Patent [19]

Schaefer

[11] Patent Number: 5,257,592

[45] Date of Patent: Nov. 2, 1993

[54] ANCHOR SHOCK ABSORBER

[76] Inventor: Rick D. Schaefer, 313 E. 1st Ave., Flandreau, S. Dak. 57028

[21] Appl. No.: 892,989

[22] Filed: Jun. 3, 1992

[51] Int. Cl.[5] ..... B63B 21/00

[52] U.S. Cl. ..... 114/215; 114/293; 441/3

[58] Field of Search ..... 114/230, 293, 294, 295, 114/296, 297, 298, 299, 301, 304, 310, 213, 215; 441/1, 3, 6, 21, 23, 26

[56] References Cited

U.S. PATENT DOCUMENTS

| | | | |
|---|---|---|---|
| 165,036 | 6/1875 | Smith | 114/215 |
| 518,502 | 4/1894 | Hammond . | |
| 593,788 | 11/1897 | Stone . | |
| 682,536 | 9/1901 | Duncanson . | |
| 730,009 | 6/1903 | Duncanson | 114/215 |
| 3,077,614 | 2/1963 | Lloyd | 114/230 |
| 3,353,817 | 1/1967 | Bollinger . | |
| 3,677,539 | 7/1992 | Bennet | 441/23 |
| 4,303,037 | 12/1981 | Helveston et al. | 114/293 |
| 5,178,087 | 1/1993 | O'nion et al. | 114/293 |

FOREIGN PATENT DOCUMENTS

| | | | |
|---|---|---|---|
| 3445971 | 6/1986 | Fed. Rep. of Germany | 441/26 |

*Primary Examiner*—David M. Mitchell
*Assistant Examiner*—Stephen P. Avila
*Attorney, Agent, or Firm*—Richard C. Litman

[57] ABSTRACT

An anchor shock absorber for use with a marine vessel anchoring system. The anchor shock absorber is purposed to relieve the strain on a rope or a cable which joins an anchoring device to the marine vessel. The anchor shock absorber includes an casing, a spring assembly interposed within the casing, and a buoyant material associated with the casing. The casing may be of a rigidly constructed independent of the buoyant material or may be formed by the buoyant material. The spring assembly includes axially disposed opposing first and second couplings. A spring is arranged between the first and second couplings in such a manner that an axial strain induced upon the anchoring system causes the first and second couplings to move in opposing directions, thus distorting the spring axially. This distortion of the spring absorbs the shock or relieves the strain sustained by the connecting line. An absence of strain allows the spring to relax, or to return a normal state or condition. The spring assembly is encased within the casing in such a manner that the first and second couplings protrude from opposite ends of the casing. The buoyant material enables the anchor shock absorber to float on the water surface. The shock absorber is capable of floating so as to allow a marine vessel user to observe the degree of strain being induced upon the anchoring system. The more visible the anchor shock absorber, the less strain being sustained by the connecting line.

20 Claims, 4 Drawing Sheets

ANCHOR SHOCK ABSORBER

BACKGROUND OF THE INVENTION

1. Field of the Invention

The present invention relates to an anchor shock absorber for use with an anchoring system for anchoring a marine vessel in a body of water more particularly, an anchor shock absorber which floats on the surface of the body of water supporting the marine vessel.

2. Description of the Prior Art

Marine vessels are held substantially stationary within a body of water through the use of an anchoring device which is joined to the marine vessel via some resilient connecting means, such as a rope or a cable. The anchoring device is lowered to the bed of the body of water and is typically configured so as to become embedded therein. Under calm conditions, the stability of the marine vessel is generally undisturbed by the body of water. However, under rough conditions, the stability of the marine vessel is most commonly disturbed by the movement of the water. This movement typically induces strain in the connecting means adjoining the anchoring device to the marine vessel. The less stable the marine vessel becomes, the greater the strain becomes, and the greater the risk of the connecting means breaking and/or the marine vessel encountering damage. An apparatus which is capable of absorbing the shock or the strain could reduce the risk of the connecting means breaking or of the marine vessel sustaining damage. An apparatus which not only absorbs shock, but also provides a means to physically observe the evidence of strain may enable an operator of a marine vessel to take precautions against the possibility of the connecting means breaking or of damage occurring to the vessel.

U.S. Pat. No. 518,502 issued Apr. 17, 1894 to R. A. Hammond, U.S. Pat. No. 593,788 issued Nov. 16, 1897 to J. B. Stone, and U.S. Pat. No. 682,536 issued Sep. 10, 1901 to W. A. Duncanson all disclose a combined spring shackle and oil distributor for attachment to anchor cables and towing hawsers of vessels. The spring shackle relieves the cable from excessive or sudden strain and the oil distributor discharges oil which is distributed upon the surface of the water. The amount of oil discharged is indicative of the degree of strain sustained by the cable.

U.S. Pat. No. 3,353,817 issued Nov. 21, 1967 to H. N. Bollinger describes a shock absorber for use, in combination with ropes and cables, in securing boats. The shock absorber is comprised of a resilient rigid coil encased within a sleeve such that opposite ends of the coil extend from opposite ends of the sleeve.

None of the above inventions and patents, taken either singly or in combination, is seen to describe the instant invention as claimed.

SUMMARY OF THE INVENTION

An anchor shock absorber for use with a marine vessel anchoring system. The anchor shock absorber is purposed to relieve the strain on an connecting means, such as a rope or a cable, which joins an anchoring device to the marine vessel. The anchor shock absorber includes a casing, a spring assembly interposed within the casing, and a buoyant material associated with the casing. The casing may be of a rigid construction independent of the buoyant material or may be defined by the buoyant material, depending on the configuration of the spring assembly. The spring assembly includes axially disposed opposing first and second couplings. A spring is arranges between the first and second couplings in such a manner that an axial strain induced upon the anchor shock absorber causes the first and second couplings to move in opposing directions, thus flexing the spring axially. This flexing of the spring absorbs the shock or relieves the strain sustained by the connecting means. An absence of strain causes the spring to relax, enabling the shock absorber to return to a normal position. The spring assembly is encased within the casing in such a manner that the first and second couplings protrude from opposite ends of the sleeve. The buoyant material ensures that the anchor shock absorber is capable of floating on a surface of a body of water which is supporting the marine vessel. The shock absorber is capable of floating so as to allow a marine vessel user to observe the degree of strain being induced upon the connecting means. The more visible the anchor shock absorber, the less strain being sustained by the connecting means.

Accordingly, it is a principal object of the invention to provide an anchor shock absorber which absorbs the shock or relieves the strain on a connecting means, such as a rope or a cable, adjoining a marine vessel to an anchoring device.

It is another object of the invention to provide an anchor shock absorber which employs a buoyant material. The buoyant material enables the anchor shock absorber to float when the connecting means is not subjected to strain. The more the anchor shock absorber is capable of floating, the less the amount of strain which is induced upon the connecting means. Conversely, the less the anchor shock absorber is permitted to float, the greater strain sustained by the connecting means.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
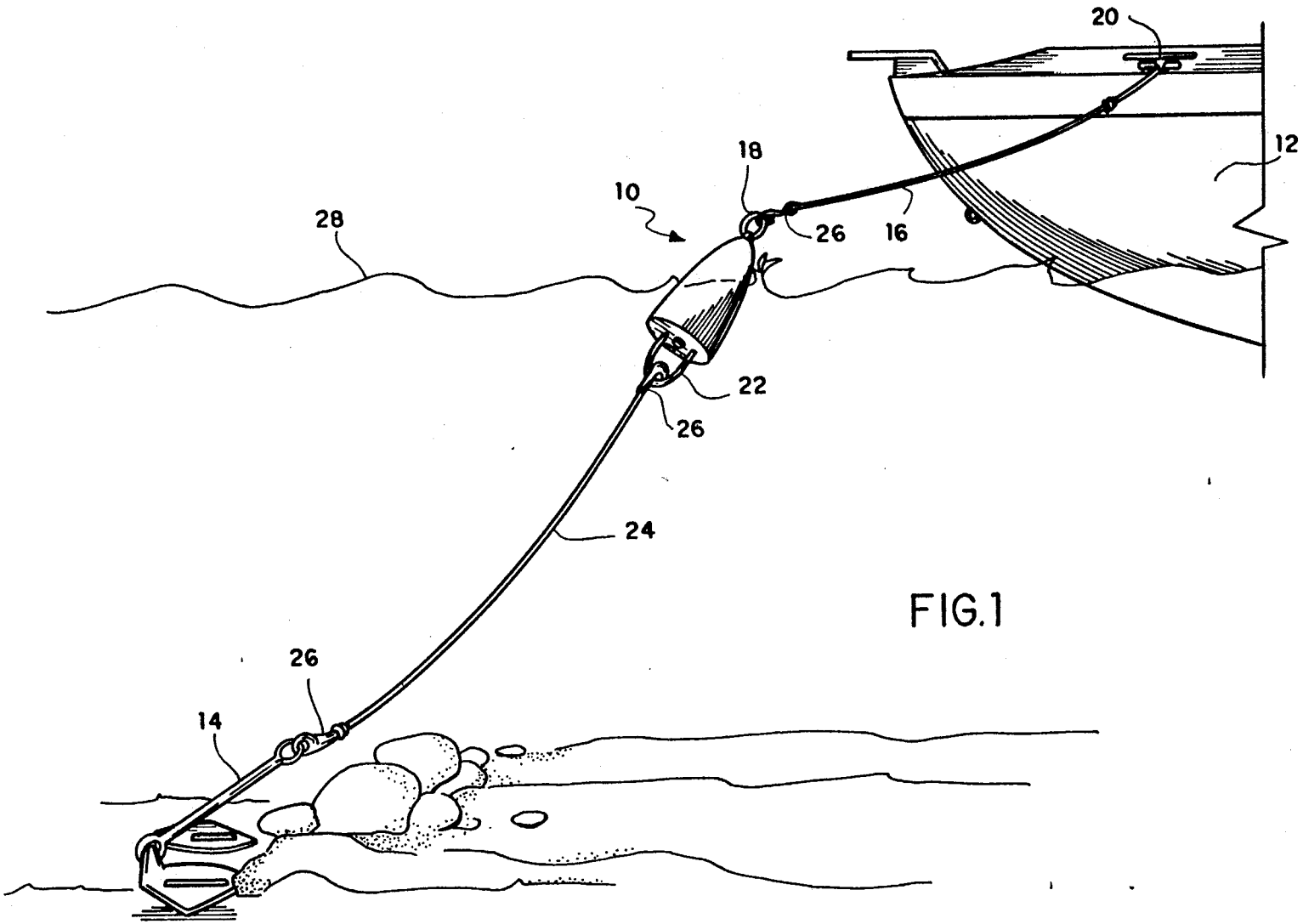
FIG. 1 is an environmental perspective view of the anchor shock absorber.

The present invention is an anchor shock absorber 10 for use with marine vessel 12 and an anchoring device 14 thereof, such as shown in FIG. 1. Preferably, the anchor shock absorber 10 is adjoined to the marine vessel 12 by attaching a one end of a first connecting means 16, such as the rope or cable shown, to an eye hook 18 located protruding from a proximal end of the anchor shock absorber 10 and attaching an opposite end of the connecting means 16 to a cleat 20 mounted on the bow of the marine vessel 12. The distal end of the anchor shock absorber 10 has a U-shaped hook 22 protruding therefrom. This U-shaped hook 22 is adjoined to the anchoring device 14 via a second connecting means 24. The second connecting means 24 has two ends, the first end being attached to the U-shaped hook 22 and the second end being fastened to the anchoring device 14. These aforementioned connection can be accomplished quite easily through the application of conventional spring biased fasteners 26. Utilizing the anchor shock absorber 10 as illustrated in FIG. 1 will enable the same to float on the surface 28 of the body of the water supporting the marine vessel 12.

Figure 2:
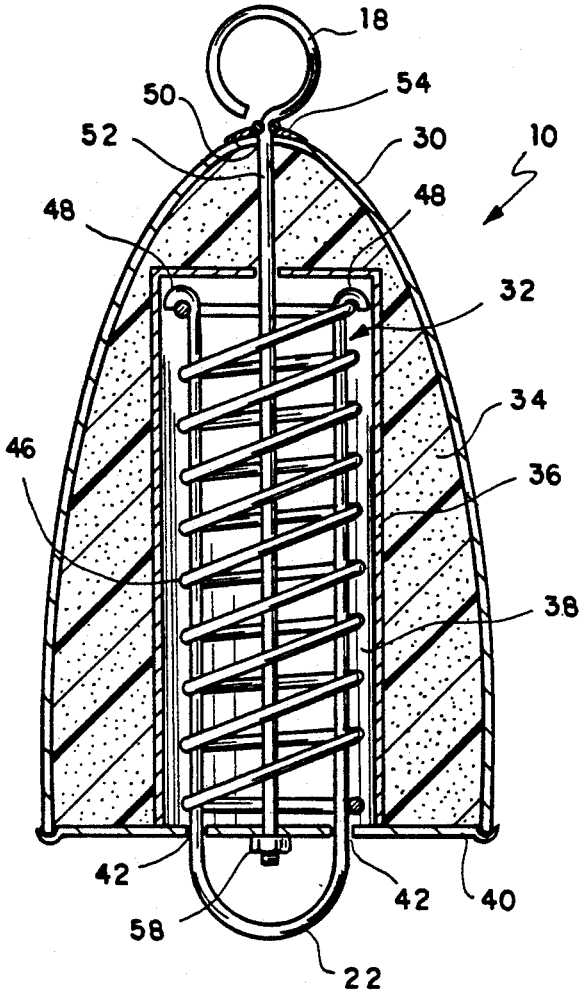
FIG. 2 is a vertical cross-sectional view of the anchor shock absorber shown in FIG. 1 with the spring in a relaxed posture.
Figure 3:
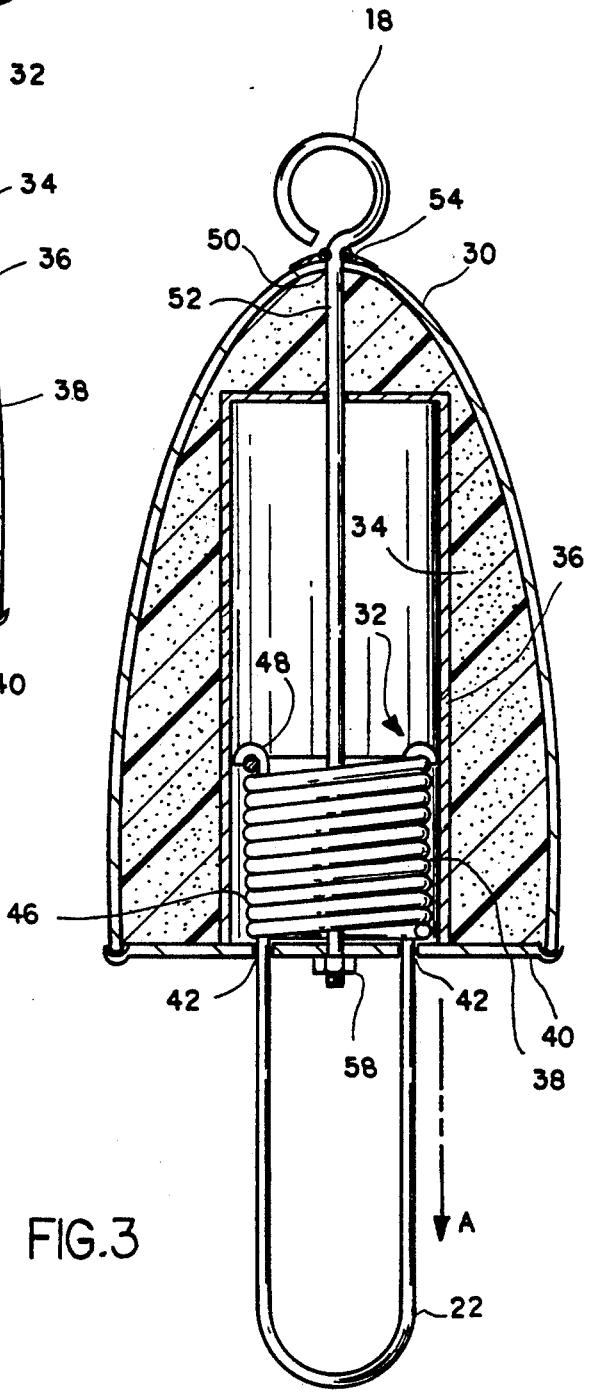
FIG. 3 is the vertical cross-sectional view of the anchor shock absorber shown in FIG. 2 with the spring in a compressed posture.

FIGS. 2 and 3 show the anchor shock absorber 10 illustrated in FIG. 1. The anchor shock absorber 10 is basically comprised of a casing 30, a spring assembly 32, and a buoyant material 34 associated with the casing 30. The casing 30 is preferably fabricated of a rigid material, such as metal. The casing 30 may be configured in any of several different configurations, but this particular embodiment is configured in the form of an ogive. The casing 30 may be coated with material, such as a rubber or plastic composition, which resists corrosion. An inner sleeve 36 is concentrically disposed interiorly of the casing 30. A cavity 38 is defined by the boundaries of the inner surface of the sleeve 36. The spring assembly 32 is removably insertable into the cavity 38. An intermediate or annular section is defined between an inner surface of the casing 30 and an outer surface of the inner sleeve 36. This annular section contains the buoyant material 34. A distal end of the casing 30 has a closure 40 removably attached thereto. The closure 40 includes a first and second opening 42, each opening 42 being radially spaced equidistantly from a center point of the closure 40. This pair of openings 42 provides a passage for the reception of the U-shaped hook 22. The U-shaped hook 22 is insertable into and through the openings 42 in the closure 40 directed inwardly of the closure 40. The U-shaped hook 22, once passed through the closure 40, is insertable interiorly of the a spring 46. A distal end of U-shaped hook 22 includes a retainer means, such as a pair of hooks, 48 for the retainment of a spring 46 against an inner surface of the closure 40. With the U-shaped hook 22, the closure 40 and the spring 46 interconnected, the closure 40 is removably attachable to the casing 30 in such a manner that the assembly is concentrically disposed within the inner sleeve 36. A proximal end of the casing 30 is provided with an opening 50 to permit the passage of a rod 52 therethrough. The eye hook 18 is integrally attached to a proximal end of the rod 52. A restrictive element 54 is located adjacent the eye hook 18 to restrict the passage of the rod 52 through the opening 50. The restrictive element may be rendered by crimping of the rod 52 to produce a pair of ears and further, by inserting the rod 52 through a concave washer that conforms to the outer periphery of the casing 30. The rod 52 is insertable into and through the casing 30 and further, through a central aperture 56 in the closure 40 which is removably attached to the casing. With the anchor shock absorber 10 assembled as shown and described, a distal end of the rod 52 protrudes from the central aperture 56 in the closure 40. A fastening means 58, such as the threadable fasteners shown, mates with this protruding end of the rod 52 to secure the closure 40 onto the casing 30 and thus, retain the spring assembly 32 within the inner sleeve 36.

Consider the anchor shock absorber 10 applied as shown in FIG. 1. With no strain being sustained by the connecting means 16,24, the spring 46 will be relaxed and the anchor shock absorber 10 will maintain a normal posture as shown in FIG. 2. When the connecting means 16,24 is subjected to strain or shock, the U-shaped hook 22 is permitted to move in the direction A, compressing the spring 46 (shown in FIG. 3) and thus, absorbing the shock or relieving the strain from the connecting means 16,24.

Figure 4:
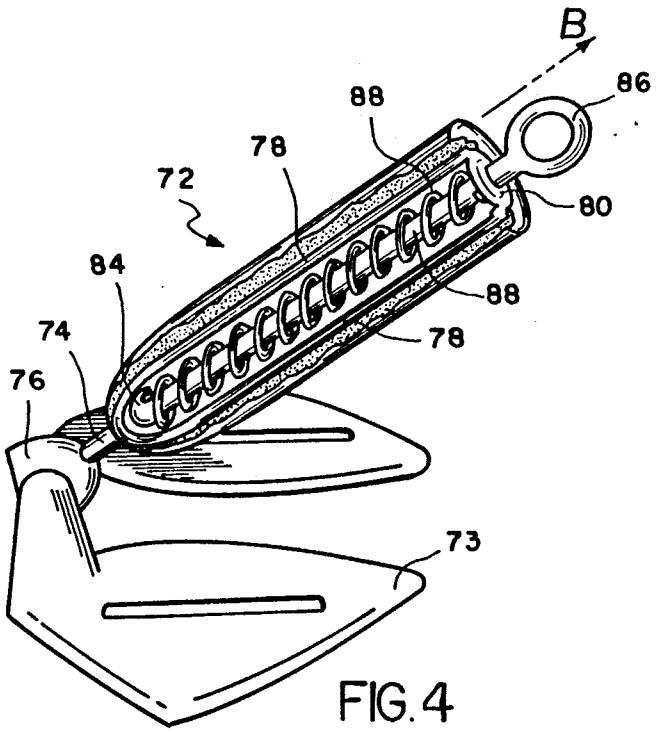
FIG. 4 is a perspective view of a first alternative anchor shock absorber shown integrally attached to an anchoring device.

FIG. 4 shows a first alternative anchor shock absorber 70 which is integrally attached to the fluke 73 of an anchoring device 72. More specifically, a rod 74 located at a distal end of the anchor shock absorber 70 has distal end which is integrally attached to the fluke 73 by a pivotal member 76. A proximal end of the rod 74 branches defining a branch point. This rod 74 branches to provide at least two parallel elongated elements 78 having a spaced apart relationship. These two elongated elements 78 converge at a convergence point adjacent to a proximal end of the anchor shock absorber 70. An aperture 80 is provided at this point of convergence for the reception of a shaft 82. This shaft 82 is configured to include a retainer means, such as a hook 84, at a distal end thereof and to include an eye hook 86 at a proximal end thereof. The anchor shock absorber 70 further includes a spring 88 which is disposed between the parallel elongated elements 74. The shaft 82 is passed through the aperture 80 and is further inserted into and through the spring 88 whereby the retainer means 84 clutches a distal end of the spring 88. Strain sustained by a connecting means, such as a rope or cable (not shown), may be relieved by the motion of the shaft 82 in the direction B. A metal cylindrical sleeve may encircle the parallel elongated elements 74, the spring 88 and the shaft 82 to restrict the motion of the shaft 82 in an axial direction. The anchor shock absorber 70 is covered with a buoyant material to ensure that the anchor shock absorber 70 maintains a substantially upright attitude.

Figure 6:
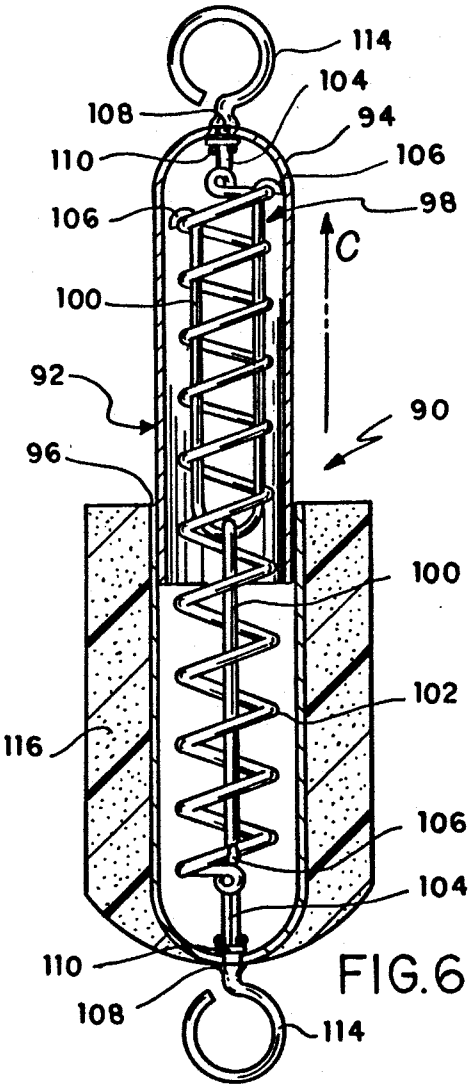
FIG. 6 is a cross-sectional view drawn along lines 6—6 of FIG. 5.
Figure 5:
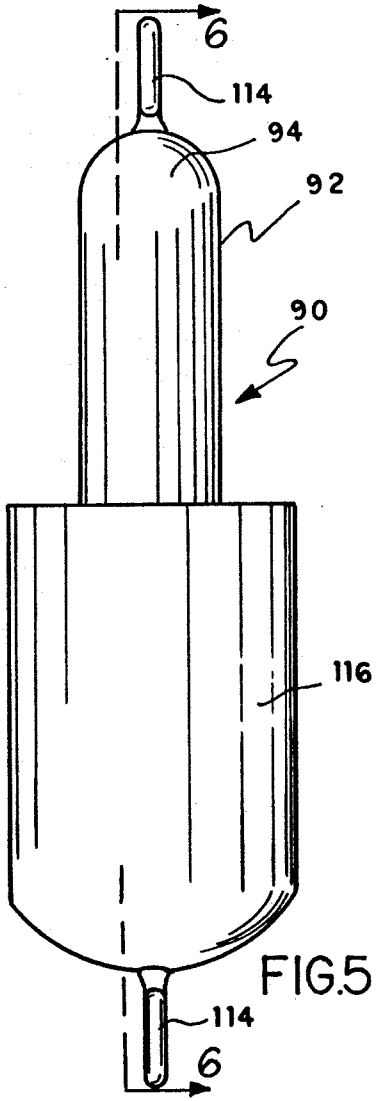
FIG. 5 is a side elevational view of a second alternative anchor shock absorber showing the spring in a flexed posture.
Figure 8:
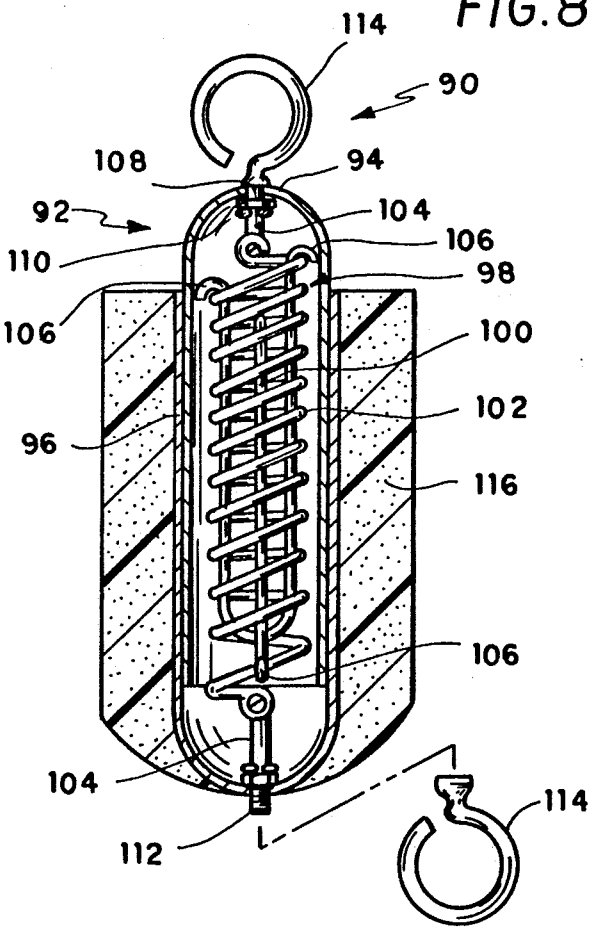
FIG. 8 is a partly exploded modified sectional view drawn along lines 8—8 of FIG. 7.
Figure 7:
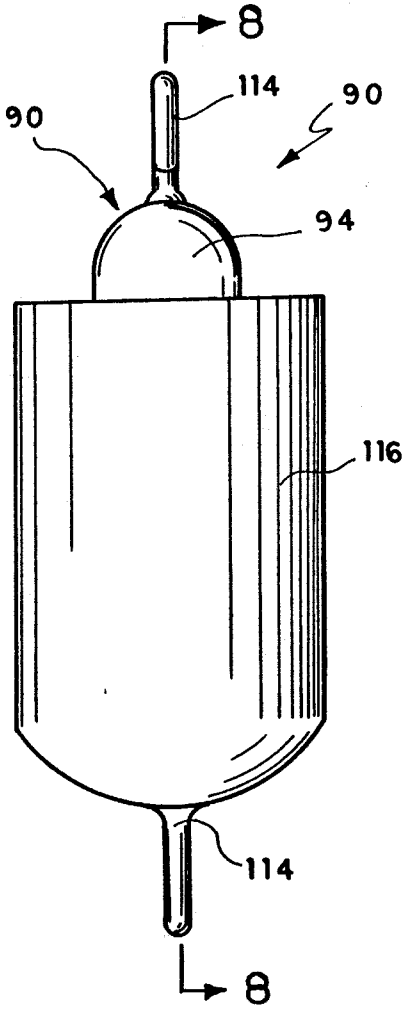
FIG. 7 is a side elevational view of a second alternative anchor shock absorber showing the spring in a relaxed posture.

FIGS. 5–8 show a second alternative anchor shock absorber 90. As shown in FIG. 6 this anchor shock absorber 90 is comprised of a capsule 92 formed of a first and second half 94,96. The capsule 92 contains a spring assembly 98 which includes a first and second U-shaped hook 100, a spring 102, and a first and second pivotal coupling rod 104. The first and second U-shaped hooks 100 are coupled together forming a coupling point. This coupling restricts axial movement of the spring assembly 98. In this coupled posture, the first and second U-shaped hooks 100 are axially insertable into and through the center of the spring 102. Each U-shaped hook 100 is provided with a first and second retainer means, such as a hook, 106. This pair of retainer means 106 facilitate in the retention of the spring 102. The spring 102 includes a first and second end, each end being pivotally connected to a pivotal coupling rod 104. One of the pivotal coupling rods 104 is permitted to pass through an aperture 108 located at a distal end of the anchor shock absorber 90 while the other pivotal coupling rod 104 is permitted to pass through a proximal end of the anchor shock absorber 90. Each pivotal coupling rod 104 is provided with a restrictive element 110 to restrict the passage of the rod 104 through the aperture 108. A portion of each pivotal coupling rod 104 which protrudes from the respective end of the anchor shock absorber 90 is provided with a fastening means 112, such as the threadable fastener shown in FIG. 8, which is fastenable to an eye hook 114. The first half 94 of the capsule 92 is slidably insertable into the second half 96 of the capsule 92. The first and second halves 94,96 are slidably joined together and are prevented from inadvertently separating by removably fastening the eye hooks 114 to the pivotal coupling rods 104. A buoyant outer sleeve 116 is removably attachable to an outer periphery of the second half 96 of the capsule 92. This buoyant outer sleeve 116 permits the device to float. FIGS. 5 and 6 show the anchor shock absorber 90 under a strain with the first and second U-shaped hooks 100 restricting the axial movement of the spring 102 in the direction C. FIGS. 7 and 8 show the anchor shock absorber 90 in a normal or relaxed posture.

It is to be understood that the present invention is not limited to the sole embodiment described above, but encompasses any and all embodiments within the scope of the following claims.

I claim:

1. An anchor shock absorber for use with an anchoring system of a marine vessel to absorb axial strain sustained by the anchoring system, said anchor shock absorber comprising:

a) a casing having a proximal end and a distal end;

b) a spring assembly being disposed interiorly of said casing, said spring assembly having a first coupling means protruding from to said proximal end of said casing and having a second coupling means protruding from said distal end of said casing, a spring being interposed between said first and second coupling means such that the axial strain induced upon said first and second coupling means causes said first and second coupling means to move in opposing directions and thus, causes said spring to distort from a normal state and an interruption in the axial strain enables said spring to relax and thus, return to said normal state, and c) a buoyant material associated with said casing, said buoyant material enables said anchor shock absorber to float on a surface of a body of water which supports the marine vessel, whereby said first coupling means is releasably attachable to the marine vessel and said second coupling means is releasably attachable to an anchoring device in such a manner that said anchor shock absorber is permitted to float until the anchoring system sustains a predetermined amount of strain and thereafter submerges beneath the surface of the body of water.

2. The anchor shock absorber according to claim 1, wherein said casing is rigidly constructed.

3. The anchor shock absorber according to claim 2, wherein a closure is removably attachable to said distal end of said casing.

4. The anchor shock absorber according to claim 3, wherein a sleeve is disposed interiorly of said casing forming an intermediate section defined by an inner surface of said casing and an outer surface of said sleeve.

5. The anchor shock absorber according to claim 4, wherein said buoyant material is contained within said intermediate section.

6. The anchor shock absorber according to claim 5, wherein said first coupling means includes an eye hook which is integrally attached to a proximal end of a rod, said rod being insertable into and through an opening in said proximal end of casing, into and through said casing and further, into and through an opening in said closure, a distal end of said rod is provided with a fastening means to secure said closure to said casing.

7. The anchor shock absorber according to claim 6, wherein said second coupling means includes a U-shaped hook which projects outwardly from said closure and which is slidably inserted inwardly into and through a first and second opening in said closure and further, into and through said spring, a proximal end of said U-shaped hook includes a retainer means which engages with a proximal end of said spring to form said spring assembly, said retainer means retains said spring against an inner surface of said closure as well as prevents said U-shaped hook from inadvertently pulling out of said casing, whereby said closure is removably attached to said casing, said spring assembly is contained within said sleeve in a normally strained state, and said rod is inserted through said spring and further, through an aperture in said closure, and thereby has a fastening means attached thereto to secure said closure to said casing.

8. The anchor shock absorber according to claim 1, wherein said casing and said spring assembly are provided with a protective coating which resists corrosion.

9. The anchor shock absorber according to claim 1, wherein said casing comprises a capsule comprising a first and second half, said capsule contains said spring assembly.

10. The anchor shock absorber according to claim 9, wherein said first half of said capsule is slidably insertable into said second half of said capsule, said first and second halves are slidably joined together and are restricted from inadvertently separating by said first and second coupling means.

11. The anchor shock absorber according to claim 9, further including an outer sleeve which is removably attachable to an outer periphery of said second half of said capsule, said buoyant material forming said outer sleeve.

12. The anchor shock absorber according to claim 9, wherein said spring assembly being defined by a first and second U-shaped hook, a spring, and a first and second pivotal coupling rod.

13. The anchor shock absorber according to claim 12, wherein said first and second U-shaped hooks are coupled together, thus forming a coupling point, said U-shaped hooks are coupled together in such a manner as to restrict axial movement of said anchor shock absorber.

14. The anchor shock absorber according to claim 12, wherein said first and second U-shaped hooks are axially insertable into and through said spring, each one of said U-shaped hooks being provided with a retainer means which facilitates in the retention of said spring about and along a length of said U-shaped hooks.

15. The anchor shock absorber according to claim 12, wherein said spring is in a normally compressed state whereby the strain sustained by said anchoring system strains said spring and an absence of the strain sustain by the anchoring system enables said spring to return to said normally compressed state.

16. The anchor shock absorber according to claim 12, wherein said spring includes a first and second end, each one of said ends being pivotally connected to one of said pivotal coupling rods, said first pivotal coupling rod passing through an aperture located at a distal end of said casing said second pivotal coupling rod passing through a proximal end of said casing.

17. The anchor shock absorber according to claim 16, wherein each of said pivotal coupling rods are provided with a restrictive element to restrict the passage of said rod respectively through said aperture.

18. The anchor shock absorber according to claim 12, wherein a portion of said first and second pivotal coupling rods each respectively project outwardly from said distal end and said proximal end of said casing, thus defining a respective first and second projecting end, each one of said projecting ends is provided with a fastening means which mates with and fastens to an eye hook, said first and second coupling means being defined by said eye hooks.

19. An anchoring device for use with an anchoring system of a marine vessel to absorb axial strain sustained by the anchoring system, said anchoring device comprising:

a) a fluke; and b) a shock absorber integrally attached to said fluke, said anchor shock absorber comprising:

1) a casing having a proximal end and a distal end;

2) a spring assembly being disposed interiorly of said casing, said spring assembly having a first coupling means protruding from to said proximal end of said casing and having a second coupling means protruding from said distal end of said casing, said second coupling means being pivotally attached to said fluke, and a spring being interposed between said first and second coupling means such that the axial strain induced upon said first and second coupling means causes said first and second coupling means to move in opposing directions and thus, causes said spring to distort from a normal state, and an interruption in the axial strain enables said spring to relax and thus, return to said normal state; and c) a buoyant material associated with said casing, said buoyant material enables said anchor shock absorber to maintain a substantially upright posture relative to said fluke, whereby said first coupling means is releasably attachable to the marine vessel and said anchor shock absorber sustains strain from the anchoring system.

20. The anchoring device according to claim 19, includes a rod located at a distal end of said anchor shock absorber, a distal end of said rod is pivotally attached to said fluke, a proximal end of said rod branches to define a branch point which provides a least two parallel elongated elements having a spaced apart relationship, said parallel elongated elements converge to define a convergence point at an end of said elongated elements opposite said branch point, an aperture is provided at said convergence point for the reception of a shaft, said shaft is configured to include a retainer means at a distal end thereof and to include an eye hook at a proximal end thereof, said spring is disposed between said parallel elongated elements, said shaft is passed through said aperture and is further, inserted into and through said spring in such a manner that said retainer means engages with a distal end of said spring, said spring assembling being formed by said elongated elements, said spring and said rod, said anchor shock absorber further comprises a cover attached to and surrounding said spring assembly, said buoyant material being defined by said cover.

* * * * *